United States Patent [19]

Sagues et al.

[11] Patent Number: 4,557,225

[45] Date of Patent: Dec. 10, 1985

[54] COMBINED HOUSING AND HEAT SINK FOR ELECTRONIC ENGINE CONTROL SYSTEM COMPONENTS

[75] Inventors: Paul Sagues, Berkeley; Peter Sagues, El Cerrito, both of Calif.

[73] Assignee: Mikuni Kogyo Kabushiki Kaisha, Tokyo, Japan

[21] Appl. No.: 571,803

[22] Filed: Jan. 18, 1984

[51] Int. Cl.[4] ..... F01P 1/06

[52] U.S. Cl. ..... 123/41.31; 123/480; 165/80.3; 361/383; 361/395

[58] Field of Search ..... 123/41.31, 41.01, 480; 165/80 A, 80 B, 185; 361/381, 382, 383, 384, 393, 394, 395, 396

[56] References Cited

U.S. PATENT DOCUMENTS

| | | | |
|---|---|---|---|
| 3,147,402 | 9/1964 | Hochstetler | 361/395 |
| 3,364,395 | 1/1968 | Donofrio et al. | 361/394 |
| 4,137,871 | 2/1979 | Martel et al. | 123/588 |
| 4,177,499 | 12/1979 | Volkmann | 361/383 |
| 4,418,673 | 12/1983 | Tominari et al. | 123/480 |

*Primary Examiner*—William A. Cuchlinski, Jr.
*Attorney, Agent, or Firm*—Owen, Wickersham & Erickson

[57] ABSTRACT

A housing assembly for retaining components of an electronic engine control system is disclosed. Components include electrical and sensor elements mounted on printed circuit boards including heat producing elements on a first board and logic, memory and processor elements together with sensors on a second board. The first board is enclosed within and connected to a main housing so that it provides a heat sink. The second board is electrically connected to the first board within the housing and supports both a fuel command sensor and also engine pressure sensors.

5 Claims, 17 Drawing Figures

COMBINED HOUSING AND HEAT SINK FOR ELECTRONIC ENGINE CONTROL SYSTEM COMPONENTS

FIELD OF THE INVENTION

This invention relates to electronic engine control systems for automotive vehicles and more particularly it relates to a housing or enclosure for retaining interconnected elements of such an engine control system so that they will be protected for operation in a suitable environment.

BACKGROUND OF THE INVENTION

In copending applications Ser. Nos. 378,285 and 400,636 assigned to the assignee of the present application, an engine control system is disclosed which utilizes a computer or microprocessor. The system disclosed is of the so-called EAC type wherein driver fuel command signals derived from actuation of the accelerator pedal are supplied to the computer, which then controls a throttle mechanism to provide the precise amount of air necessary to produce an optimum air-fuel ratio. Electronically, insofar as components are concerned, the system includes a first printed circuit board on which are mounted the elements comprising the computer or CPU unit, a second or power supply board that handles all of the power control elements of the system, a driver command signal generator and various pressure sensors adapted for connection with certain engine locations which are required for throttle valve control inputs. All of the aforesaid components must be packaged in a housing that is compact, that is readily mountable in an accessible location in the engine or passenger area, that will dissipate heat and provide an acceptable temperature environment for all system elements under varying conditions, and that will provide a high degree of protection for these elements and thus assure safety and reliability for the engine.

Most automotive computers in use today are relatively simple devices which dissipate small amounts of heat. The trend, however, is toward more complex computers which perform more control functions. Each control function requires an actuator of some kind (e.g. a motor, a fuel injector, or a light bulb). In order to power the actuator, a solid state switch of some kind must be used. These switches are not 100% efficient, therefore some of the power they use is lost in the form of heat. Then too, the computer circuitry utilizes a fixed voltage (often 5 volts) to power its circuitry. The voltage regulation circuits usually dissipate considerable heat.

To dissipate heat and maintain environmental temperature within limits, the heat-generating devices must be held in close contact to a large heat conducting structure usually called a heat sink. Traditionally, the attachment of the heat-generating devices is by means of screws or rivets. Such attachment is costly in terms of time and materials, and removal is often more difficult.

The requirements for the computer enclosure are several, therefore. First, a considerable amount of power must be dissipated in the form of heat. Often amounts approaching 100 watts must be rejected. Second, the enclosure must protect the computer circuitry from the high temperatures associated with the power producing circuits. Third, the computer must be protected from the electrical noise which is often generated by the power switching devices. Fourth, a rigid case or enclosure must be provided which protects the computer from trauma and the elements. Fifth, the power-generating devices in the system must be connected to the heat sink quickly and reliably without individually attaching each device.

Another problem which arose with automotive engine control systems heretofore devised was in providing reliable and accurate driver fuel command signals as well as proper signals from other pressure sensors.

In conventional vehicles powered by a gasoline internal combustion engine, the driver's right-most pedal influences the power output of the engine. Generally, the pedal is connected via a cable or rod to a throttle plate which is located in the intake air stream. Depression of the pedal allows more air to enter the engine. Heretofore, the engine was fitted with a carburetor, and the increased airflow caused increased fuel to flow into the air stream and therefore increased engine power. If the engine was fitted with a conventional fuel injection system, an airflow sensor or manifold pressure sensor detected the increased airflow and caused more fuel to be injected into the air stream. In some fuel injection systems, a sensor located at the throttle plate sensed the angle of the throttle (and therefore the driver pedal position). This signal was used to detect changes in the driver's pedal position in order that the fuel injection system could more quickly respond to changes in the pedal position and therefore reduce the tendency to go lean upon acceleration. It is important to note that this pedal sensor was not used as the sole basis of adding fuel to the engine.

In an EAC system, the driver's right-most foot pedal is not connected to the throttle. Rather, the driver's pedal position provides an input to a computer. The computer determines the amount of fuel to be added and actuates fuel injectors. The computer also determines the amount of air which should be admitted to the engine and commands a motor-driven throttle plate in the air intake manifold to the correct position. Unlike the conventional (EFC) fuel injection system in which the driver's pedal position controls the throttle directly and the pedal sensor only measures the change in position, in the case of EAC, the driver's pedal position is resolved by the computer solely on the basis of the sensor. The driver's pedal position (called the driver fuel command) determines the power output of the engine. The driver fuel command is therefore an extremely important signal whose correct resolution is vitally necessary to proper engine operation and performance.

If the driver fuel command sensor is located at some distance from the computer, then the driver fuel command signal must be transmitted through wires via an electrical signal. If the electrical signal were modified in such a way that the computer would incorrectly determine the driver's pedal position, then serious damage or injury could occur. If, for example, the wires carrying the driver fuel command signal were traumatized, the result could be that the computer would misinterpret the driver's pedal position. In addition, a sensor which is separated from the computer must be shielded from dirt, dust, moisture, and electrical noise, and the electrical wires connecting the sensor and the computer must be shielded from electrical noise. Provisions must also be taken to prevent unauthorized tampering with the wires or installation of "hand throttles" which violate motor vehicle laws.

The location of various required engine sensors and their proper connection with the engine control system is also important to the smooth and reliable operation of the system.

In some fuel-injected automobiles, a pressure sensor (also called a pressure transducer) measured the absolute pressure within the engine manifold. An electrical signal was produced by the transducer which was in some manner proportional to manifold pressure. An electrical circuit which might contain a computer used the electrical signal to measure airflow into the engine. The pressure transducer was typically mounted on or near the engine, and an electrical signal carried the pressure information to the electrical control unit.

In an EAC system which measures airflow by measuring pressure drop across the throttle, a pressure transducer is needed to allow the control computer to determine pressure drop. Typically, a differential pressure transducer is used which is designed to measure a pressure difference. Pressure drop across the throttle measures the volume flow of air past the throttle. Because the air/fuel ratio of the engine is extremely important, and because the air/fuel ratio is based upon the mass of fuel and air and not the volume of fuel and air, a correction must be made to to the measure of the volume flow of air past the throttle. Measuring the temperature of the air and the absolute pressure of the air allows a volume-to-mass-flow correction to be made.

Thus, an EAC system, as described, requires two pressure transducers, one to measure the differential pressure across the throttle and one to measure the absolute pressure of the air above the throttle. Using prior techniques, both transducers were mounted on or near the engine, and the pressure signals furnished to the engine control computer sensors were required to be capable of withstanding high under-hood temperatures. Second, the sensors were required to be protected from the electrical noise of the high voltage ignition system. Third, the interconnecting wires were required to be shielded from electrical noise. Fourth, the sensors needed to be protected from dirt, dust, vibration, and moisture. Fifth, a connector, was required to allow the pressure sensor to be installed onto the end of an electrical cable harness.

It is therefore a general object of the present invention to provide a single housing or enclosure for an automotive engine control system that solves the aforesaid problems and fulfills the aforesaid requirements.

Another object of the invention is to provide an improved housing for an electronic engine control system that is easy to assemble and yet provides firm reliable electrical connections between components.

Another object of the invention is to provide an electronic engine control system with an improved housing that will dissipate at a relatively high rate the heat produced internally by power-consuming electrical elements of the system, thereby widening the range of locations where the housing can be installed in proximity to the engine.

Another more specific object of the invention is to provide an enclosure with an automotive engine control system including a computer which affords protection from excess heat as well as from extraneous, outside forces and electrical noise that could otherwise damage the computer or cause erroneous signals.

Still another object of the invention is to provide an automotive fuel control system of the EAC type that will enable its computer to determine, with a high degree of accuracy and reliability, the position of the driver's fuel command pedal.

Another object of the invention is to provide an automotive engine control system with an enclosure having a driver command sensor mounted within the enclosure adjacent the system electronics, thereby making the sensor more tamper proof, and protecting it from external forces so that it is more reliable.

Yet another object of the invention is to provide an electronic engine control system wherein all of the systems electronics, the driver command sensor and also manifold and absolute pressure sensors are enclosed within a single housing.

A further object of the present invention is to provide an electronic engine control system with a housing or enclosure that accommodates the major elements thereof in a manner that is particularly well adapted for ease and economy of manufacture.

Another object of the invention is to provide a compact housing for elements of an electronic engine control system, including its electronic components as well as certain sensors, which is particularly well adapted for ease of installation and accessability for testing and maintenance.

SUMMARY OF THE INVENTION

In accordance with the invention, a housing package is provided comprising an aluminum heat sink component for power-consuming elements that also forms one basic element of a computer enclosure. Two circuit boards fit in close proximity to the heat sink and metal bottom and end covers enclose the boards. One of the two boards, called the power board, contains a series of transistors that function as the voltage regulators and power switches. In order to hold them in close thermal contact with the heat sink, the power devices are aligned in two rows. When the power board is assembled, it fits into the heat sink so that the two rows of power devices fit flush against an inner side surface of the heat sink. Two metal strips which are tightened from outside the heat sink grip the two rows of transistors and hold them in close thermal proximity to the internal heat sink surfaces. Thus each power transistors held so as to conduct its heat to the heat sink but does not need to be individually screwed or riveted to it. Yet, assembly as well as removal of the power board is equally easy.

A second board or CPU board for the engine control system contains its microprocessor and memory, the sensitive analog circuitry, the pressure transducers, the driver fuel demand sensors, and small signal connectors. To shield the CPU board from both heat and electrical interference, a thermal insulator and electrical shield are placed between the power and CPU boards. The CPU board connects with the power board by way of interboard connectors. The arrangement enables the CPU board to obtain its power from the power board and send output signals to the power switching devices located on the power board. The CPU board is enabled to operate at a lower temperature than the power board and is protected from the electrical noise on the power board. In addition to its heat dissipation functions, the enclosure also protects the computer from dust, moisture, and trauma.

According to the present invention, the driver's fuel command pedal is connected via a linkage to a mechanism within the computer enclosure. Two springs, one compressed by pedal-down motion and one stretched by pedal-up motion are used to return the mechanism to the pedal-up position when not depressed by the driver. The mechanism includes a linear slider member that carries two permanent magnets which are directed in such a manner that the magnetic flux influences a Hall-effect sensor fixed to the CPU board. The nature of the Hall-effect sensor is such that it produces an electrical voltage which is some function of the magnetic flux to which it is exposed. Therefore, depression of the driver pedal produces an analog voltage without the need for a conventional potentiometer as used heretofore, which required a mechanical wiper that was subject to considerable wear. Wear is, therefore, greatly reduced. In addition, a protective conformal coating may be applied to the entire computer circuit board including the Hall-effect sensor without affecting the ability of the sensor to measure the pedal position. No wires or connectors are used to connect the driver fuel command signal to the computer since the sensor is mounted directly on the printed circuit board.

Although the probability of damage to the sensor is greatly reduced because the sensor is within the computer enclosure, another type of failure of the Hall-effect sensor could erroneously produce a voltage which does not reflect the actual position of the pedal. Failure of the analog-to-digital converter could create a similar problem. In order to enable the computer to detect such a malfunction, two Hall-effect limit switches are placed in such a way that one switch is actuated when the pedal is in the pedal-up position and the other switch is actuated when the pedal is in the pedal-down position. The same magnets on the slider which affect the main linear Hall-effect sensor are used to trigger the digital Hall-effect sensors.

The computer senses the state of the limit switches each time it measures the voltage at the linear Hall-effect sensor. If the computer measures a large voltage from the Hall-effect sensor which would indicate a large pedal depression and if the computer senses that the pedal up Hall-effect sensor indicated pedal-up, then the computer determines that an error exists and reduces the engine power output to the safe pedal-up position.

A second function of the limit switches is to allow calibration of the linear Hall-effect sensor. As temperature changes and as the magnets age, the magnetic flux changes. The voltage which the computer measures at the extreme pedal-up and pedal-down positions may vary by perhaps 15%. In order to compensate for these changes, the computer uses information from the Hall-effect limit switches. For example, if the computer measures a normal pedal depression and then detects that the pedal-down limit switch becomes actuated, the computer will assign the voltage measured from the linear Hall-effect sensor the value of "full pedal-down", despite the fact that the voltage is only 85% of the normal full-pedal value. Recalibration has been accomplished.

According to another feature of the invention, two pressure transducers, one differential and one absolute, are mounted directly on the computer circuit board within the computer enclosure. The transducers derive power from and supply signals to the circuit board. Because the proximity of these transducers to the power supply and analog signal processing circuitry, no special care need be taken to protect the signals from electrical interference from the engine ignition. The environment to which the transducers are exposed is less severe than the usual under-hood environment, since the computer enclosure is generally mounted under the dashboard within the passenger compartment. No connector is required to install the transducer; the transducer is soldered directly to the circuit board.

The pressure transducers are connected by way of small hoses to the manifold of the engine. Because no gasses flow through the hoses, the hoses may be very small. The rate of pressure signal propagation through the hoses is essentially sonic; so very little delay is incurred by locating the sensors at some distance from the manifold. The hoses act as accumulators to some extent and therefore protect the pressure transducers from damage by manifold explosions or backfires.

The housing shell and cover and the two boards with all the attached electrical elements and sensors, as well as the insulation members, are all sized so that they fit together in a compact package with a minimum of unused space. Thus, the entire housing package can be relatively small and therefore adaptable for installation in a wide range of locations in or near the engine compartment.

Other objects, advantages and features of the invention will become apparent from the following detailed description of one embodiment of the invention presented in conjunction with the accompanying drawing.

DETAILED DESCRIPTION OF EMBODIMENT

Figure 1:
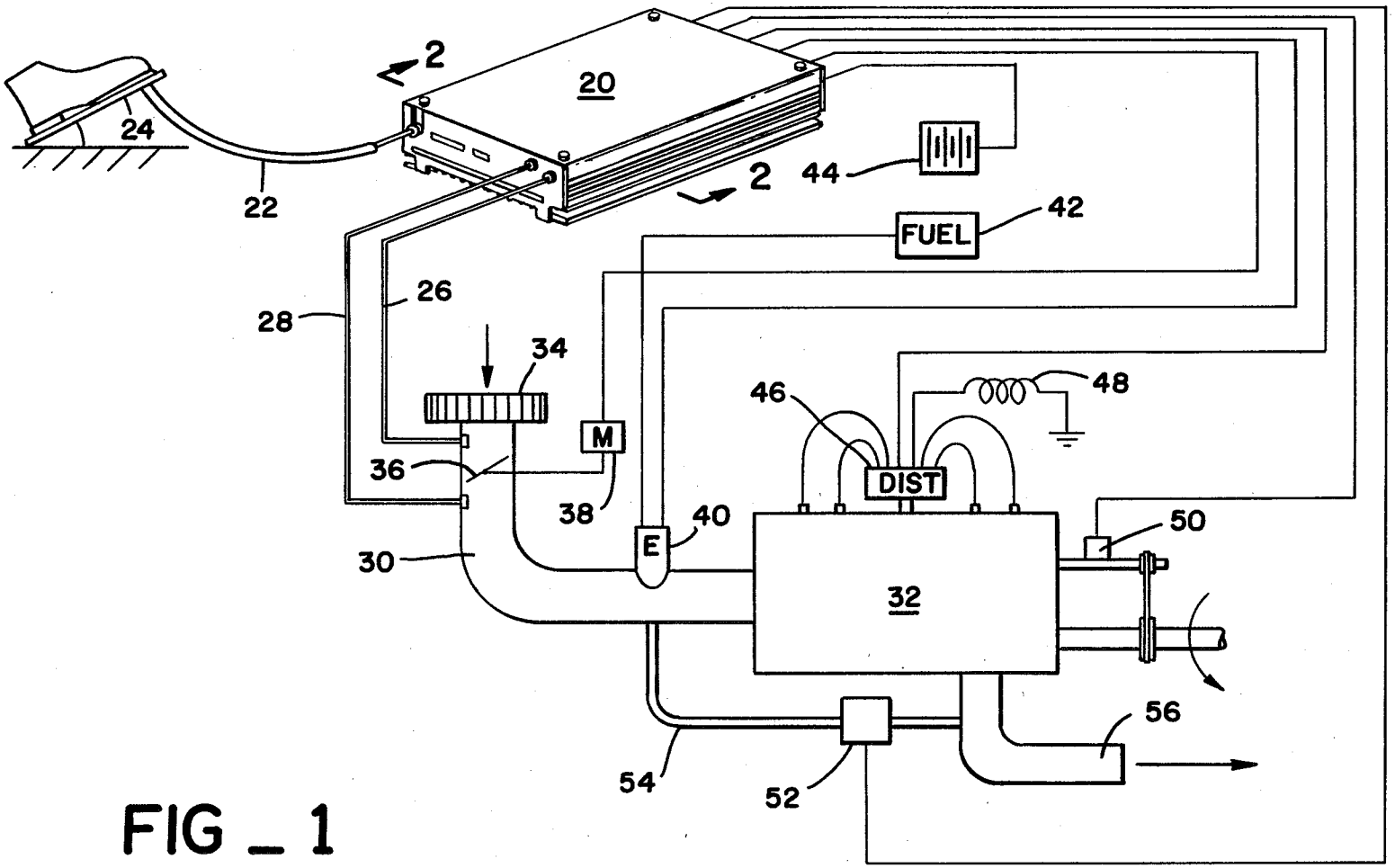
FIG. 1 is a schematic diagram of an electronic engine control system showing in perspective an electronic component assembly and housing according to the present invention.

With reference to the drawing, FIG. 1 shows diagrammatically an electronic control system for an internal combustion engine particularly adapted for installation in an automobile. Forming a basic component of the system, according to the invention, is a compact housing 20 that contains the electronic circuit components and certain sensors for the control system. Connected to the housing 20 by an actuating cable 22 is an accelerator pedal 24, which operates a fuel demand sensor within the housing. A pair of tube members 26 and 28 are connected to an air intake manifold 30 for the engine 32, which receives air through an inlet filter 34. The air pressure for tubes 26 and 28 is tapped at upstream and downstream locations relative to a throttle valve 36 within the air manifold, whose angular position for varying the amount of air flow is controlled by a step motor 38. Downstream from the throttle valve 36 is a fuel injector 40, (or there are separate injectors for each cylinder), and the injector 40 is connected by a suitable conduit to a fuel supply 42. In operation, the operator actuates the pedal 24 to create a fuel demand signal which is generated within the housing 20 and furnished directly to a computer therein. The exact amount of air required to provide an optimum air fuel ratio is determined by the computer, and signals are furnished thereby to control the step motor 38 which moves the throttle valve to produce the precise air flow required.

Electrical conduits are connected between the housing 20 and a power source (e.g. battery) 44; between the housing 20 and the fuel flow injector 40 (or injectors); and between the housing 20 and an engine spark generator, such as a distributor 46 which has one wire connected to a step-up coil 48 and other wires connected to engine spark plugs in the conventional manner. Other electrical conduits extend from various other sensors on the engine to provide additional inputs such as outside air temperature, engine temperature, engine speed, and engine cylinder timing (e.g. from a camshaft sensor 50) to the computer within the control system housing 20. Other control signals from the computer may be furnished, such as to an exhaust gas recirculation (EGR) valve 52 in a conduit 54 connected between the engine exhaust pipe 56 and the air manifold 30.

Figure 2:
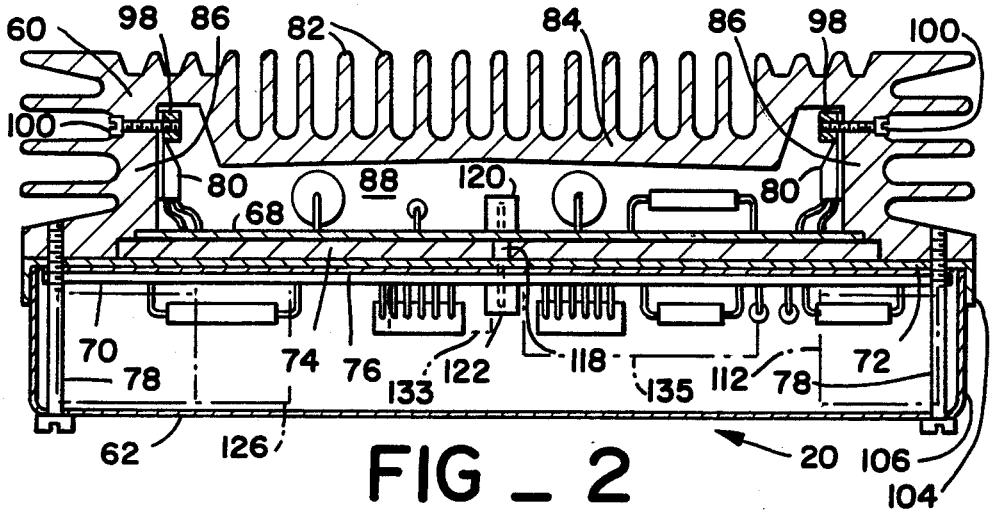
FIG. 2 is a view in elevation and in section of the engine control assembly and housing taken along line 2—2 of FIG. 1.
Figure 3:
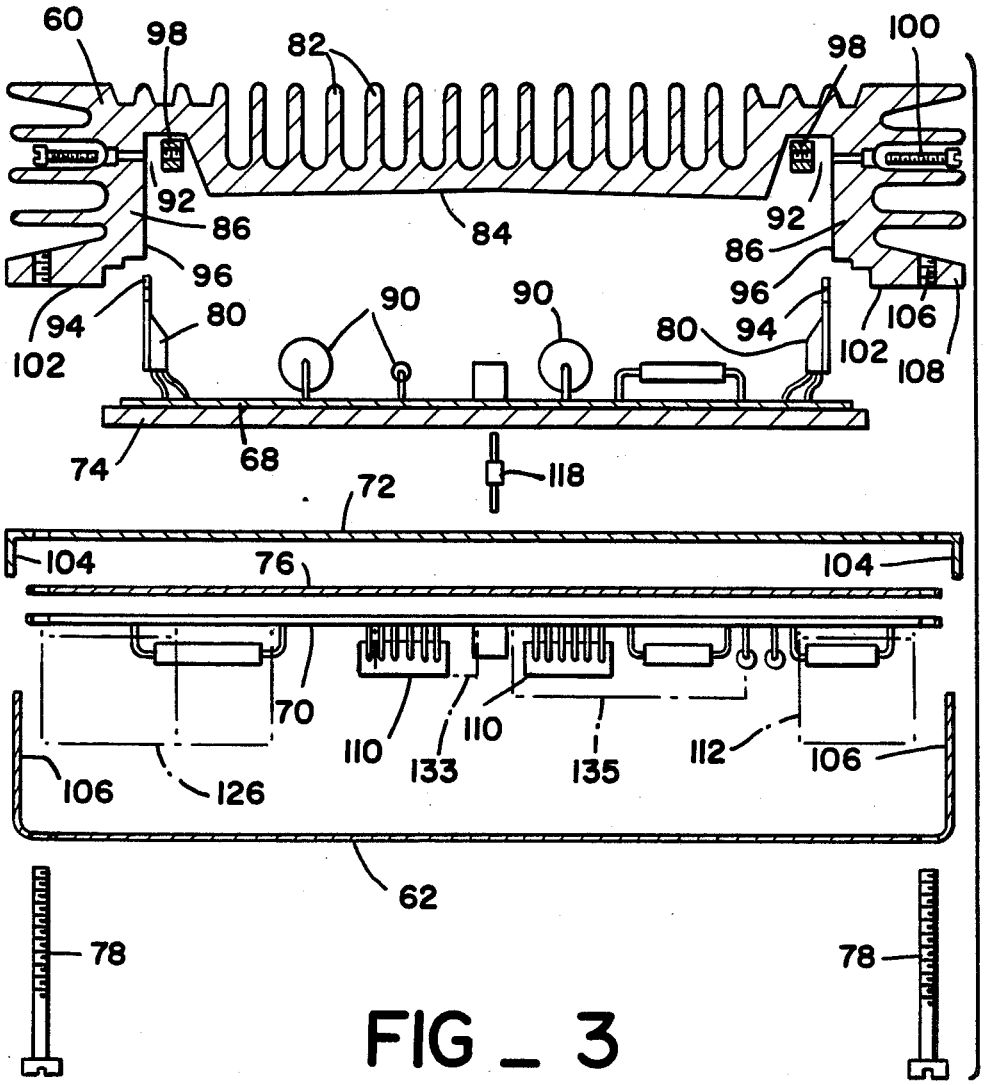
FIG. 3 is an exploded view in elevation and in section of the major components of the engine control assembly and housing of FIG. 2, prior to assembly.
Figure 4:
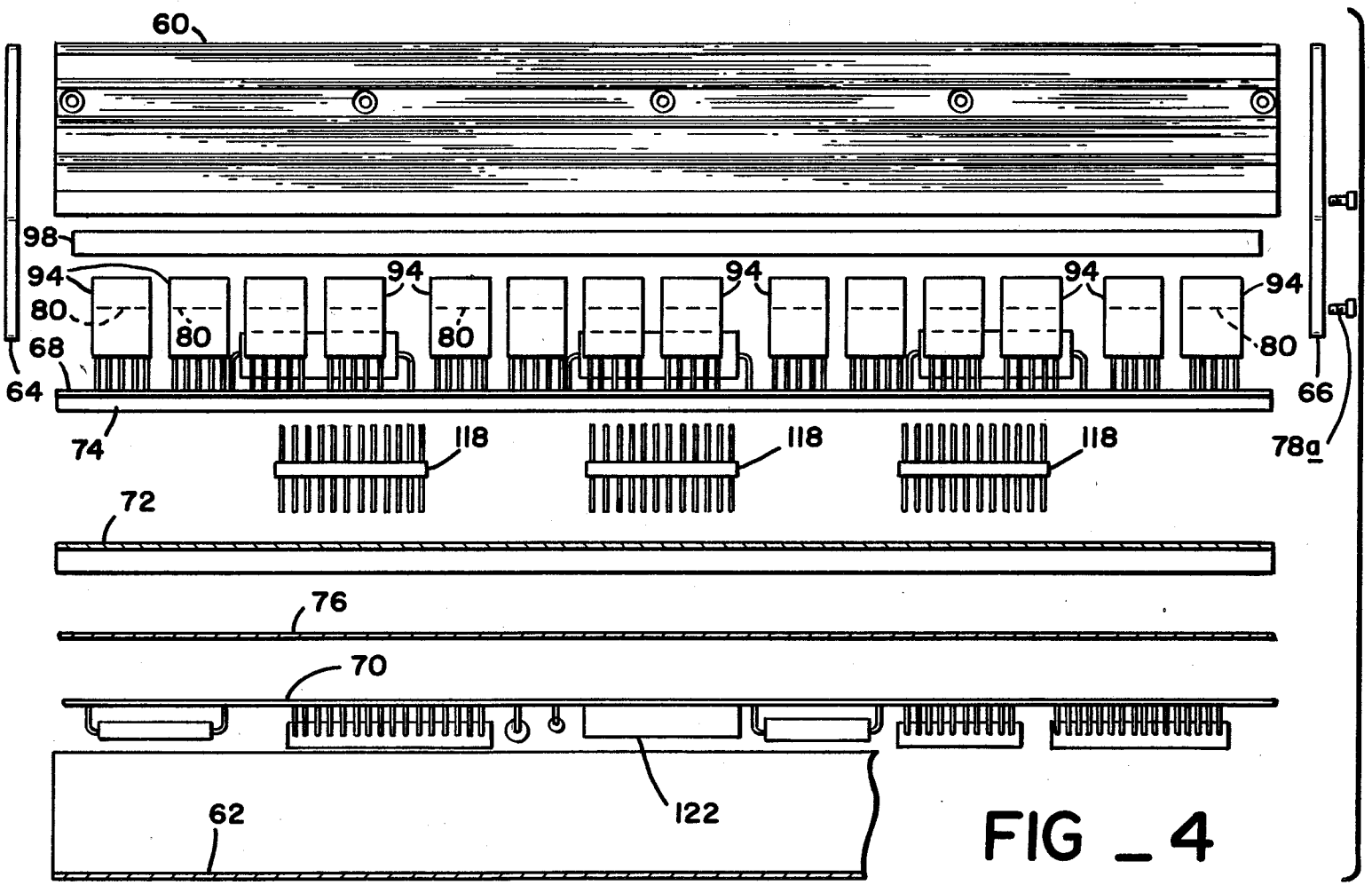
FIG. 4 is an exploded view in elevation and partly in section showing the major components of the engine control assembly and housing prior to assembly.

As shown in FIGS. 2–4, the electronic housing 20 is comprised of a main housing member 60, a bottom cover 62 and end cover members 64 and 66. Within the housing 20 are retained two printed circuit boards 68 and 70 separated by an intermediate or divider member 72 and internal insulating sheet members 74 and 76. As shown in FIGS. 2 and 3, these members are held together in a compact assembly by a plurality of machine screws 78.

The first circuit board 68, designated the "power board", supports a series of power driver transistors 80 for converting power supplied from a source such as a battery to regulated power at a precise level for use by various computer components.

Unlike previous automotive computer-controlled fuel-injection systems, the present system uses no external resistors to limit current to the injectors or to the throttle stepping motor. Instead, injector driver transistors (e.g. Motorola MC3484-V2) are used for both injectors and stepping motors. As a result, the heat losses imposed by these drivers must be dissipated. In addition, the losses of the voltage regulators must be dissipated. This is accomplished in the present invention by the main housing member 60 which forms a heat sink as well as a container for the computer elements. The housing member 60 is preferably made of extruded aluminum and its exterior is formed with a series of cooling fins 82 which provide an enlarged external area of heat dissipating surface. As shown in the cross-sectional views of FIGS. 2 and 3, the main housing member 60 has a top portion 84 and integral side wall portions 86 that form an internal space 88 to accommodate the projecting electronic elements 90 on the power board 68. Along opposite sides of the top housing portion 84 are a pair of longitudinally extending grooves 92. Each groove 92 serves to accommodate a series or a row of the power transistors 80 that extend upwardly from opposite sides of the power board 68 at spaced apart intervals. Each of the power transistors 80 has a metal conductive tab 94 (see FIG. 3) that is adapted to lie flush against an adjacent inner wall surface 96 of the main housing member 60 when the power board is properly positioned therein. Within each of the grooves 92 is an elongated retainer member 98 that extends across all of the conductive tabs 94 of the transistors on one side of the power board. Each retainer member 98 is drilled and tapped at spaced-apart intervals so that machine screws 100 along each side of the main housing member 60 can be used to pull the retainer member 98 tightly against the aligned transistor tabs 94 and thereby hold them firmly against the adjacent wall surface 96.

The intermediate plate or divider plate member 72 of the housing is adapted to fit against flat bottom-edge surfaces 102 of the side walls 86, and preferably has downwardly extending side flanges 104. The bottom cover 62, preferably made of sheet metal, also has side flanges 106 which are adapted to fit just inside the flanges 104. The machine screws 78 that hold the bottom cover in place extend into tapped holes 106 in a bottom flange 108 that is integral with each housing side wall 86.

The second board or CPU board 70 and its underlying insulation sheet 76 are held against the intermediate plate 72 by the screws 78. Fixed to this board 70 are the electronic elements 110 comprising the computer CPU circuits including, memory, digital I/O, timers, and analog-to-digital converters. It also supports a driver fuel command sensor 112 as well as two pressure sensors 124 and 126 for the throttle control, as described in greater detail below. Since the CPU board 70 does not have any power regulating transistors, it does not generate nearly as much heat as the power board 68. All of the electronic elements including resistors, capacitors and semiconductor intergrated circuit devices are arranged on one side of the board and extend into the space afforded by the bottom cover 62.

The two circuit boards 68 and 70 are electrically interconnected by standard pin connectors 118 adapted to fit within receptacle members 120 and 122 fixed at intervals to the two boards. (See FIG. 2) Pins from opposite sides of each connector extend through the intermediate plate 72 and the insulation members 74 and 76 and fit into the appropriate receptacle members on each of the circuit boards. Thus, when necessary to service the computer, the separately supported circuit boards 68 and 70 can be quickly separated and disconnected from each other.

Figure 5:
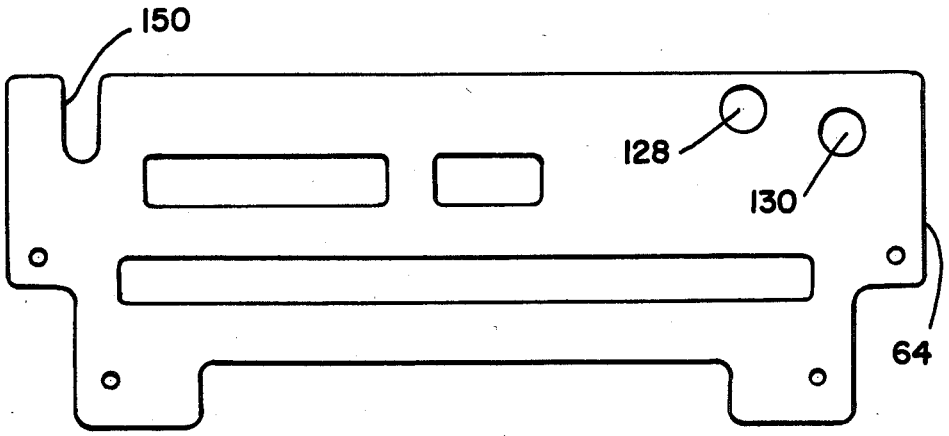
FIG. 5 is an elevation view of one end plate for the engine control system housing of FIG. 1.
Figure 6:
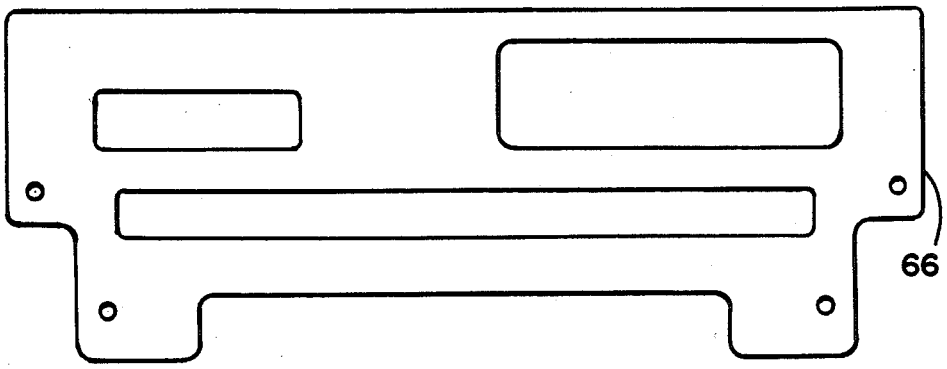
FIG. 6 is an elevation view of the other end plate for the engine control system housing of FIG. 1.

The end cover members 64 and 66 as shown in FIGS. 5 and 6 are made of sheet metal and are preferably held to the main housing member 60 by machine screws. Each of these end members 64 and 66 is provided with appropriate openings to receive the various tubes, wires and cables for the internal components of the control assembly.

Figure 7:
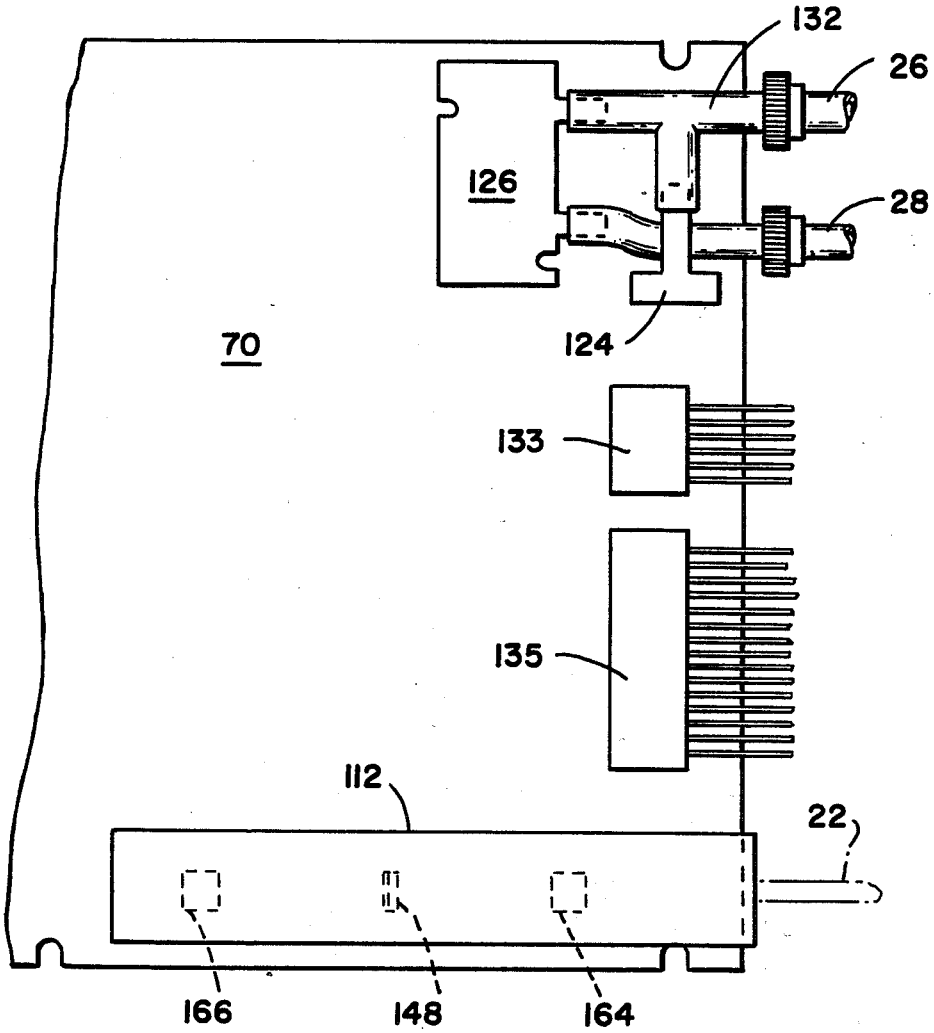
FIG. 7 is a fragmentary plan view of the end portion of one internal board of the engine control system assembly showing connections to sensors and electrical terminals on the board.
Figure 8:
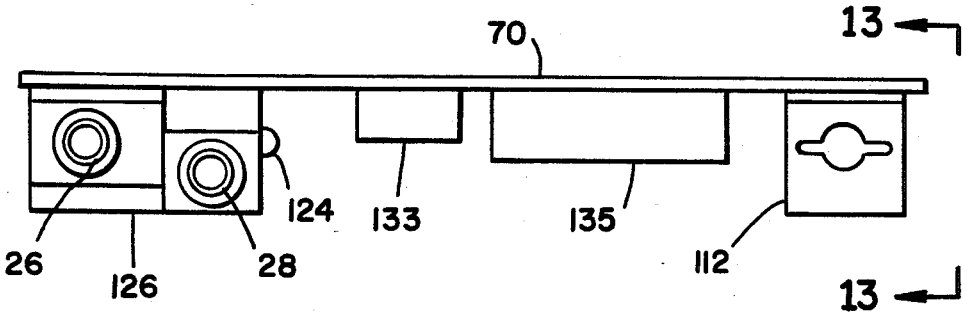
FIG. 8 is an end view in elevation of the board shown in FIG. 7.

As mentioned previously, the driver fuel demand sensor or signal generator device 112 is mounted directly on the CPU board 70 near one corner thereof, as shown in FIG. 7. The present invention also provides for installation of two pressure transducers 124 and 126 on the CPU circuit board 70. The first transducer 126 senses differential pressure, while the second transducer 124 senses absolute pressure, and these sensors are connected by the small air tubes 26 and 28 to their pickup locations on opposite sides of the air intake manifold throttle valve 36. (See FIG. 1). These air tubes extend through openings 128 and 130 in the end plate 64 (See FIG. 5) and are connected to suitable fittings. One tube 26 connects to a two outlet T-type manifold 132 (See FIG. 7), which, in turn, connects with a separate inlet port on each of the transducers 124 and 126. The other tube 28 connects only to a second post on the differential transducer 124. Both transducers are firmly fixed to the CPU board 70 to provide pressure information in the form of electrical signals directly to the computer section of the CPU board. Mounted between the pressure sensors 124 and 126 and the driver fuel command sensor 112 are standard electrical connectors for various wires extending to and from the engine. A six lead terminal 133 and a fifteen lead terminal 135 are shown in FIGS. 7 and 8, but other types could of course be used. All of the elements except the driver fuel command 112* as well as the aforesaid pressure and fuel demand sensors are preferably coated with a protective material that covers the entire board 70.

*Note: Board is first coated and then driver fuel command slider assembly is then installed. Thus Hall effect sensor is coated but magnet assembly is not gummed up.

Figure 9:
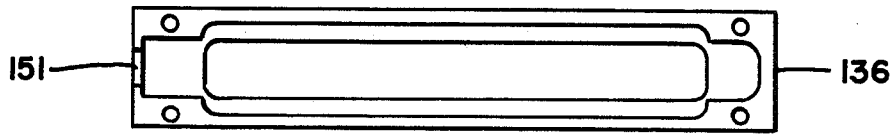
FIG. 9 is a top view (with the cover removed) of the support element for the fuel demand sensor according to the present invention.
Figure 10A:
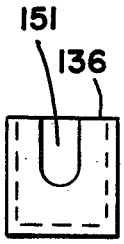
FIGS. 10*a* and 10*b* are views in elevation taken from opposite ends of the element of FIG. 10.
Figure 10:
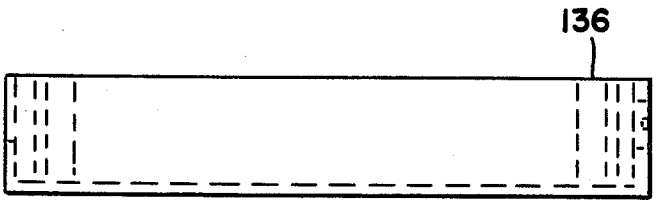
FIG. 10 is a side view in elevation of the support element for the fuel demand sensor shown in FIG. 9.
Figure 10B:
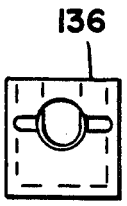
Figure 11:
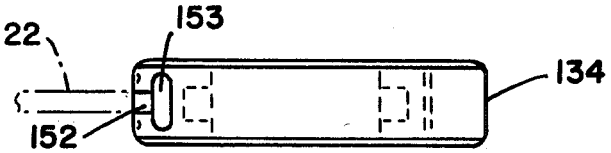
FIG. 11 is a top view of the slider member for the fuel demand sensor shown in FIG. 9.
Figure 12A:
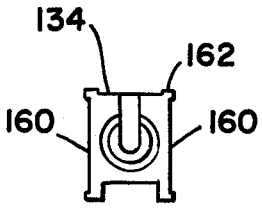
FIGS. 12*a* and 12*b* are views in elevation taken from opposite ends of the slider member of FIG. 12.
Figure 12:
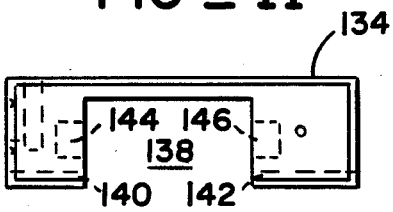
FIG. 12 is a side view in elevation of the slider member of FIG. 11.
Figure 12B:
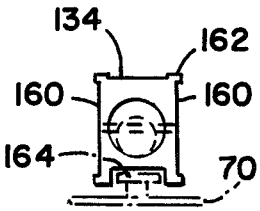
Figure 13:
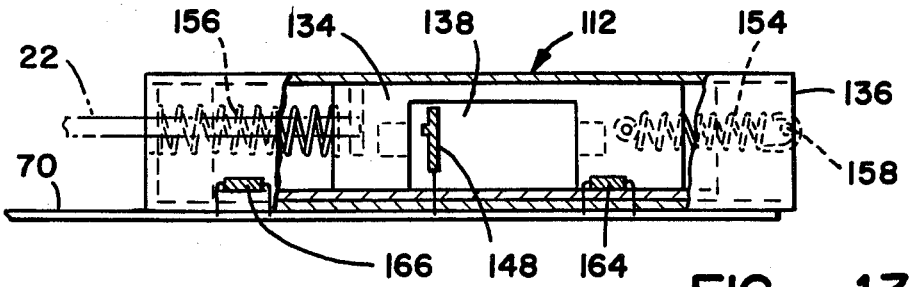
FIG. 13 is a fragmentary view in elevation of the fuel demand sensor according to the invention, looking along the line 13—13 in FIG. 8, with portions broken away to show the slider member within the support element.

The driver fuel demand device 112 utilizes a "Hall-effect" sensor and comprises a linearly movable slider 134 mounted within a support member 136 (See FIG. 13) fixed directly to the CPU board 70. The movable slider 134 shown in FIG. 12, has a notched-out central space 138 formed by spaced apart surfaces 140 and 142, each having an embedded magnet 144 and 146, so that a stable magnetic flux pattern is created between the magnets within the control space 138. The sensor itself, for example, a Hall-effect position sensor No. 91SS12-2 made by Micro Switch, a division of Honeywell, is mounted on the CPU circuit board 70 (and is designated by number 148 in FIG. 13) so that it extends into the central space 138 between the magnets 144 and 146. As shown in FIG. 13, the slider member 134 is connected at one end to the cable (or rod linkage) 22 from the accelerator pedal 24; the cable 22 extends within the computer housing 20 through a slot 150 in the end member 64 (See FIG. 5) and through a slot 151 in one end of the support member 136 (FIGS. 9 and 10*a*). An enlarged end 153 of the control cable 22 fits within a retention slot 152 at the end of the movable member 134 (See FIG. 11). The movable member 134 is also connected to its support member 136 at the opposite ends by a pair of coil springs 154 and 156 (See FIG. 13). One spring 154 is stretched by pedal-down motion and is retained by a roll pin 158 at one end of the support member 136, while the second spring 156 is compressed by the same motion, both springs serving to return the movable slider member 134 to the pedal-up position when the pedal 24 is not depressed by the driver. The outer side faces 160 of the movable slider 134 (See FIGS. 12*a* and 12*b*) are slightly recessed so that only its corners 162 engage the inner surfaces of the support member 136, thereby affording a minimum of friction during back and forth linear movements. Preferably, both the slider 134 and its support member 136 are made of a hard durable plastic so that friction and wear is reduced and the slider will move freely on response to pedal movements.

The magnets 144 and 146 on the slider 134 are thereby located so that their magnetic flux influences the Hall-effect sensor 148 fixed to the CPU board 70 and extending upwardly into the notched out space 138 between the magnets 144 and 146. The nature of this Hall effect sensor 148 is such that it produces an electrical voltage proportional to the magnetic flux to which it is exposed. Thus, depression of the driver pedal 24, which moves the slider 134, produces an analog voltage without the need for a conventional potentiometer, which requires a mechanical wiper. Since the slider 134 is essentially suspended by the springs 154 and 156 within the support member 138, the moving friction it encounters, and thus the wear factor of the fuel demand signal generator is negligible. In addition, since a conformal passivating coating may be applied to the entire computer circuit board 70 including the Hall effect sensor 148 but not indicating the slider assembly without affecting the ability of the sensor to measure the pedal position, additional protection is provided. Also, since the sensor 148 is mounted directly on the CPU board 70, no wires or connectors are required.

Although the probability of damage to the fuel signal generator 112 is greatly reduced, because it is included within the computer enclosure, electrical failure of the Hall-effect sensor 148 itself could result in a voltage being produced by it which does not reflect the true position of the pedal 24. Failure of the analog-to-digital converter could create a similar problem. In order to allow the computer to detect such a malfunction, two Hall-effect limit switches 164 and 166 are mounted on the CPU board 70 and placed in such a way that one switch 164 is actuated when the pedal 24 is in the pedal-up position and the other switch 166 is actuated when the pedal is in the pedal-down position. The same magnets 144 and 146 on the slider 134 which affect the linear Hall-effect sensor 148 are used to trigger these digital Hall-effect sensors 164 and 166, which are also fixed directly to the CPU board.

In operation, the computer senses the state of the limit switches 164 and 166 each time it measures the voltage at the linear Hall-effect sensor 148. That is, the computer forms an input cycle which determines whether the digital Hall-effect sensor 164 is supplying an on or off signal to an input port of the computer. If the computer measures a large voltage from the linear sensor 148, which would indicate a large pedal depression, and if the computer senses that the pedal-up Hall-effect sensor 164 indicated pedal-up by being on, then the computer would determine that an error discrepancy exists and would reduce the engine power output to a value which is safe for the pedal-up position. In other words, whenever the slider member 134 is moved to the extreme pedal-up position, the linear Hall-effect sensor 148 normally produces a small voltage or essentially an off signal and the limit sensor 164 will produce an on signal. If, for some reason the sensor 148 does not operate properly and produces an abnormally large voltage for the pedal-up position, the computer will detect the discrepancy and automatically reduce engine power.

A second function of the limit switches 164 and 166 is to allow calibration of the linear Hall-effect sensor 148. As temperature changes and as the magnets age, the magnetic flux produced by them changes. The voltage which the computer measures at the extreme pedal-up and pedal-down positions may vary by as much as 15%. In order to compensate for these changes, the computer uses information from the Hall-effect limit switches 164 and 166. For example, if the computer measures a normal pedal depression and then detects that the pedal-down limit switch 166 becomes actuated, the computer will cause the engine to produce the power normally associated with the full pedal-down position despite the fact that the voltage may be only 85% of the normal pedal-down value due to changes in the flux of the magnets. Recalibration has thus been accomplished.

With the driver's fuel command signal generator 112 mounted on the board 70 within the housing 20, it is completely protected from extraneous forces that otherwise might cause its erroneous operation. Yet its operation can be extremely smooth and highly responsive to pedal actuation as well as being accurate and precise, since no wires or connectors are used and the signals produced are furnished essentially directly to the computer.

From the foregoing, it is apparent that the present invention provides a compact housing and assembly for an electronic fuel control system wherein the major electronic and sensor elements are all contained within a protective enclosure that can be installed in a variety of different locations. Not only the reliability and durability of the system assured, but its smooth and efficient operability is greatly enhanced by the shortening and direct connection of vital signal paths.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

What is claimed is:

1. An enclosure containing elements of an electronic fuel control system comprising:

a main housing of heat conducting metal having a relatively thick top portion and sidewalls forming a recessed space with elongated grooves adjacent each sidewall on opposite sides of said top portion, each said groove having at least one planar inner surface;

a first printed circuit board with heat producing electronic elements arranged in two rows on opposite sides of said board, said elements in each said row having projecting tab portions that extend into one of said grooves;

strip means in each said groove for retaining said tap portions therein against the planar inner surface of said groove and thereby causing heat conduction from said electronic elements into said main housing member;

a second printed circuit board with logic, memory and processor elements;

insulation means between said first and second boards;

means for electrically interconnecting said boards within said enclosure;

and cover means extending between said sidewalls for holding said boards firmly within said enclosure.

2. An enclosure containing elements of an electronic fuel control system comprising:

a main heat-dissipating housing member of heat conducting metal having a relatively thick top portion and relatively thick sidewalls with exterior heat-dissipating fins and defining an upwardly recessed space below said top portion;

a lower planar member extending between said sidewalls of said main housing member;

a first printed circuit board on said lower member, with heat-producing electronic elements mounted on its upper face and located within said recessed space;

a second printed circuit board located below said lower member of said main housing member and spaced down from said first board, with logic, memory and processor elements mounted on its lower face;

heat and electrical insulation means interposed between said first and second boards;

connection means for electrically interconnecting said circuit boards within said enclosure; and a lower cover means extending down from said sidewalls to a bottom wall and forming a lower space containing said second board within said enclosure;

wherein said main housing member has elongated grooves adjacent to and parallel to each sidewall on an interior wall of its said top portion, each said groove having at least one planar inner surface;

said heat-producing electronic elements being arranged in two rows on opposite ends of said board, said elements in each said row having projecting tab portions that extend into one of said grooves;

strip means in each said groove; and securing means securing said strip means to said sidewalls and retaining said tab portions against a planar inner surface of said groove, thereby conducting heat from said electronic elements into said heat-dissipating main housing member.

3. An enclosure containing elements of an electronic fuel control system for an automotive vehicle having an accelerator pedal and an engine with fuel supply and fuel injection means for controlling the amount of fuel supplied and an intake manifold comprising:

an upper heat-dissipating housing member for a first printed circuit board with heat producing elements; and a lower member containing a second printed circuit board with computer components including logic, memory and processor elements along with two pressure transducers and a driver-fuel command sensor;

insulation means in said enclosure between said first and second boards;

connector means for electrically interconnecting said boards within said enclosure;

pressure transmitting tubes connecting said pressure transducers to said intake manifold for conversion of the absolute pressure at the entry of air into said intake manifold and the differential pressure between the air-entry pressure and the manifold pressure, into electrical signals;

short electrical connection means inside said enclosure connecting each said pressure transducer to said computer;

linkage means connected to said accelerator pedal and extending to and into said enclosure and connected then to said sensor;

short electrical connection means inside said enclosure connecting said sensor to said computer; and electrical leads extending from said computer to said fuel supply and control means;

wherein said sensor comprises a support member affixed directly to said second circuit board;

a slider within said support member and movable relatively thereto and connected to it by a coil spring at each end, said slider also connected to a linkage at one end thereof;

said slider having a notched-out control space with a magnet at each end thereof; and a Hall-effect sensor secured to said second circuit board so as to lie in between said two magnets at all times, under the influence of their magnetic flux.

4. A system as described in claim 3 having two Hall-effect limit switches mounted in said second circuit board and located apart thereon so that one limit switch is adjacent a magnet in said slider in a maximum fuel command mode and the other limit switch is adjacent the other magnet in said slider in a minimum fuel command mode.

5. An enclosure containing elements of an electronic fuel control system comprising:

a main housing means with sidewalls forming a recessed space;

circuit board means with electronic elements thereon for said system including heat producing power elements as well as logic, memory and processor elements;

a pair of pressure transducers mounted on said board means and adapted for connection to pressure-transmitting tubes extending from sources of pressure to be evaluated, and short electrical connections inside said enclosure for connecting said pressure transducer to said processor elements;

fuel command sensor means for said system mounted on said board means and adapted for connection with pedal means exterior to said enclosure said fuel command sensor means comprising:

a support means fixed to said board means;

a slider means in said support means connected to cable means extending from said enclosure;

a cut-out portion of said slider means forming opposing, spaced apart faces with a magnet mounted in each said face;

a Hall-effect sensor mounted on said board means and extending into said cut-out portion between said magnets;

said Hall-effect sensor being connected to said processor elements and providing a variable voltage signal thereto which is dependent on its position relative to said magnets and thus the linear position of said slider means;

and cover means extending between said sidewalls for holding said board means within said enclosure.

* * * * *